United States Patent [19]

Scheffel

[11] Patent Number: 4,480,553

[45] Date of Patent: Nov. 6, 1984

[54] STABILIZED RAILWAY VEHICLE

[75] Inventor: Herbert Scheffel, Pretoria, South Africa

[73] Assignee: South African Inventions Development Corporation, Pretoria, South Africa

[21] Appl. No.: 413,409

[22] Filed: Aug. 31, 1982

[30] Foreign Application Priority Data

Aug. 31, 1981 [ZA] South Africa ..... 81/6026

[51] Int. Cl.[3] ..... B61F 5/38

[52] U.S. Cl. ..... 105/167; 105/176; 105/182 R

[58] Field of Search ..... 105/168, 167, 165, 157 R, 105/176, 182 R, 135, 199 R

[56] References Cited

U.S. PATENT DOCUMENTS

| | | | |
|---|---|---|---|
| 424,089 | 3/1890 | Bosdevex | 105/168 |
| 1,051,214 | 1/1913 | Gawley | 105/168 |
| 2,005,607 | 6/1935 | Bourdon | 105/215 C X |
| 4,067,261 | 1/1978 | Scheffel | 105/157 R |
| 4,111,131 | 9/1978 | Bullock | 105/167 X |

*Primary Examiner*—Randolph Reese

*Attorney, Agent, or Firm*—Schwartz, Jeffery, Schwaab, Mack, Blumenthal & Koch

[57] ABSTRACT

A railway bogie is disclosed with wheels of high effective conicity and supported on the wheels through pads with low yaw constraint so that they are self-steering. Cross-members connecting diagonally opposed wheels interconnect yawing movements of the wheelset in opposite senses to counteract the tendency to hunt. Wheels on the same side of the bogie are connected by links pivoted on a lever pivoted on the bogie frame at one end and on the bearings of the wheelsets at the other end. This interconnection inhibits the bogies frame from moving longitudinally when braking or traction forces are present and ensures that yawing movements of the frame are effectively transmitted through the wheelsets and then to the wheel/rail contact area.

5 Claims, 4 Drawing Figures

STABILIZED RAILWAY VEHICLE

FIELD OF THE INVENTION

This invention relates to railway vehicles and in particular to suspension structures for such vehicles. The invention is applicable to railway vehicles in which a body or super structure is pivotally supported on two bogies and to railway vehicles in which the vehicle body is directly supported on the wheelsets, e.g. four-wheeled vehicles known in the art as "Four-Wheelers".

In the specification the term "railway truck" is defined to mean a railway unit including a load-bearing means supported on at least two wheelsets. Thus a railway truck may be a bogie or a Four-Wheeler with the "load-bearing means" being the body in the event of a Four-Wheeler and being the frame in the event of a bogie.

BACKGROUND OF THE INVENTION

In a railway vehicle the various masses, such as body and bogies can exhibit undesirable oscillations, such as rolling, yawing and lateral movements. The wheel-sets, particularly, may oscillate undesirably in the lateral plane and excite oscillations of the other vehicle masses at certain speeds.

U.S. Pat. No. 4,067,261 discloses a railway truck in which the wheel treads are of relatively high effective conicity and each wheelset is resiliently suspended to the load-bearing means such that each wheelset is substantially self-steering, i.e. on curved track the wheelsets naturally align themselves along the radius of the curve and the correct rolling diameter between the inner and outer wheel is attained. This feature ensures that there is minimal wheel-tread and rail wear. Such wheelsets would normally tend to be highly unstable, i.e. oscillate seriously, on both straight or curved track because of the resilient suspension of the wheelsets and the forces generated by the tapered wheel-treads. However, the patent also teaches a coupling acting directly between the wheelsets which interconnects yawing movements of the wheelsets in opposite senses, i.e. 180° out of phase with each other, so as to counteract this tendency to hunt by ensuring that, ultimately, hunting stabilizing creep forces are generated in the wheel-tread/rail contact areas. The coupling does not interfere with the self-steering characteristic of the wheelsets. The coupling extends substantially diagonally of the railway truck and may be in the form of diagonal linkages or articulated sub-frames. Such couplings ensure that wheelset stability is obtained even up to very high speeds.

In a bogie type vehicle some stability of each bogie frame is also obtained because of the inter-connection of the bogies to each other through the body and the connection of each bogie frame to the wheelsets and thence to the track. However, since with self steering bogies the connections between the frame and wheelsets are necessarily resilient with low stiffness in the longitudinal and lateral directions in order to achieve the natural self-steering of the wheelsets, the amount of stabilisation obtained through the interaction of the bogie frames via the vehicle body is insignificant and only the stabilising action between the wheelsets of each bogie is available and controls the maximum speed of the vehicle.

Another problem with the self-steering, stabilized railway trucks of the type mentioned above is that there can be longitudinal movements of the wheelsets relatively to each other and to the load-bearing means, such as during braking, because of the low longitudinal stiffness of the resilient elements connecting the wheelsets to the load-bearing means. The patent mentioned above discloses longitudinal anchors connecting the centre of yaw of each wheelset to the bogie frame to overcome this problem. These anchors have not proved to be acceptable in practice for two reasons. Firstly because of the problems and expenses of fitting a central bearing on each wheelset and the space considerations, and secondly because they have been found to have a destabilizing effect as they introduce a lateral connection between the wheelsets and the load-bearing means.

This invention seeks at least to minimise the above mentioned problems in a satisfactory manner without affecting the natural self-steering property of the wheelsets and the stabilizing action of the suspension.

SUMMARY OF THE INVENTION

According to the invention there is provided a railway truck having a longitudinal axis in its direction of travel and comprising a load-bearing means; two wheelsets each including an axle fixed to two wheels that have tapered treads for generating steering forces on track curves; a pair of axle boxes on each wheelset; resilient suspension elements suspending the load-bearing means on the axle boxes and permitting each wheelset at least to approach a radial position in a curve; and interconnecting means extending substantially diagonally of the truck and interconnecting the wheelsets to couple their yawing and lateral movements in opposite senses to counteract the tendency of the wheelsets to hunt without interfering with their natural curving characteristics with the improvement of additional connecting means which includes on each side and spaced from the longitudinal axis of the truck a pair of linkages and a lever arm pivoted at a position between its ends on the load-bearing means about an axis midway between and parallel to the axles with linkages on the same side of the truck connected to opposed ends of the lever arm and each to a separate axle box and with the lever arm being independent of any other connection to the load-bearing means.

The diagonal interconnecting means stabilizes the tendency of the resiliently suspended wheelsets to hunt. The additional interconnecting means for doing so performs the following functions. Firstly, function is that it inhibits the load-bearing means from moving longitudinally relative to the wheelsets when braking or traction forces are present by acting to ensure that on each side of the truck the spacings between each axle box and the pivot axis of the lever are equal.

Secondly, it ensures that yawing movements of the load-bearing means are effectively transmitted through to the wheelsets and thence through to the wheel/rail contact areas. This function applies particularly when the railway truck is a bogie as defined above and a body is pivotally supported on two bogies.

DESCRIPTION OF PREFERRED EMBODIMENTS

Figure 1:
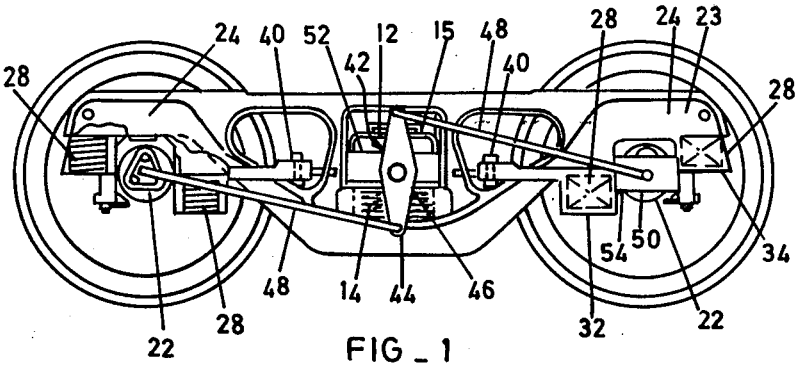
FIG. 1 shows a side view, with parts broken away for clarity, of a railway bogie of the invention fitted with first and additional inter-connecting means for coupling the yawing movements of a pair of wheel-sets in opposite senses.
Figure 2:
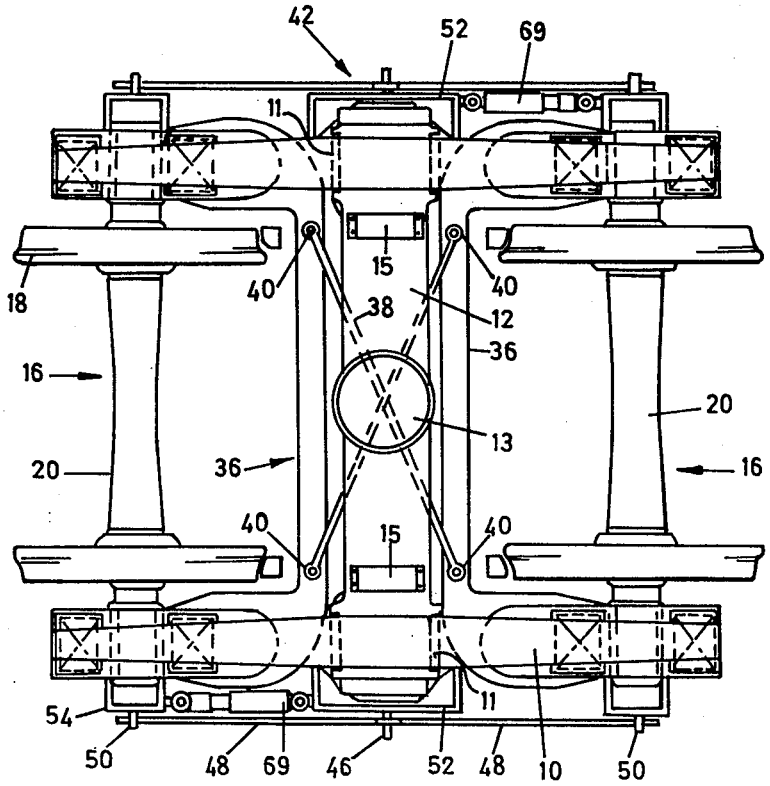
FIG. 2 shows a plan view of the embodiment of FIG. 1.

FIGS. 1 and 2 of the drawings show a three-piece bogie including two side-frames 10 and a bolster 12 supported by coil springs 14 for vertical movement on the side-frames 10. Friction wedges 11 of known type are provided between the bolster and side-frame so that in yaw the bolster and side frames move as a unit.

The bolster is essentially of a hollow, elongate box construction. The side frames 10 are resiliently suspended on two wheelsets 16 each comprising a pair of wheels 18 fast or solidly mounted on an axle 20. The axles rotate in bearings 22. Each bearing 22 is connected to a side-frame 10 by a metal pad 24 having an arcuate lower surface which rests on the bearing 22; a spring adaptor 26 which rests on an upper surface of the pad 24; and two rubber sandwich elements 28 each of which is mounted on a support 32 or 34 of the adaptor 26 and which support the side-frame 10. Each rubber sandwich element 28 comprises alternate layers of rubber and metal plate. The bolster has a conventional female wear-plate 13 for pivotally supporting a superstructure or body as well as a pair of still supports 15 in the known manner. Friction material may be provided on the wear plate 13. Each adaptor 24 is channel shaped in cross-section.

A cast or fabricated sub-frame 36 for each wheelset 16 is secured to the adaptors 26. Crossed diagonally extending linkages 38 are pivotally connected by pins and bushes 40 between the sub-frames 36 to form a first interconnecting means for coupling yawing and lateral movements of the wheelsets 16 in opposite senses.

Single-acting brakes are provided for each wheel. Brake-beams and other components for the brakes have not been shown as these may be of any known form.

Each wheel 18 has a profiled tread with a high effective conicity, e.g. a "standard wear profile" or other suitable profile.

The elastomeric elements 28 impose yaw and lateral constraints, i.e. a restoring moment or couple, on each wheelset which is sufficiently low to permit each wheelset to attain a radial position in a curve when subject to the steering forces generated by the wheel treads on the rails.

Thus, in combination with the profile of the wheel-tread each wheelset is self-steering, i.e. it will curve without slip between the wheels and the rails and without the flanges of the wheels contacting the rails.

Also provided on the bogie is an additional interconnecting means 42 comprising, on each side of the longitudinal axis of the truck, a lever 44 pivoted on a stub axle 46 and a link 48 pivotably connected between opposite ends of the lever 44 and a pin 50 on each axle bearing 22. The stub axle 46 is supported on a bridge 52 that is welded to the side-frame 10 and straddles the bolster 12. Each pin 50 is similarly supported on a bridge 54 that is fixed to an adaptor 26 and straddles the bearing 22 on which the adaptor is mounted. The pins 50 are each in line with the axis of a wheelset. The axle 46 is midway between the wheelset axes and positioned substantially in the general horizontal plane containing the wheelset axes. The lever 44 is slidable axially on the axle 46. The bridge 54 may be omitted and the pins 50 each mounted directly on an adaptor 26 at a point displaced from the wheelset axis without seriously affecting the operation of the interconnecting means provided the link 48 is aligned with the rotational axis of the wheelset. Instead of having the lever 44 slidable on the stub axle 46, the connections between the links 48 and the lever 44 and the axle bearings 22 can be universal joints or ball joints so that lateral movements of the side frames is not connected to the wheelsets.

A longitudinal damper 69 which connects the axle box of one wheelset to the bridge 52 on the bogie frame is fitted on each side of the bogie and the additional interconnecting means ensure that the damping force is equally applied on both wheelsets.

The additional interconnecting means 42 does not interfere with the natural self-steering ability of the wheelsets each of which is still permitted to align itself to be radial in a curve.

As discussed above this additional interconnecting means 42 couples longitudinal and yawing movements of the bogie frame to the wheelsets. Restraints generated in the centre coupling 13 ensure that the coupling of yawing movements is also transmitted to and from a body supported on the bogie.

Figure 3:
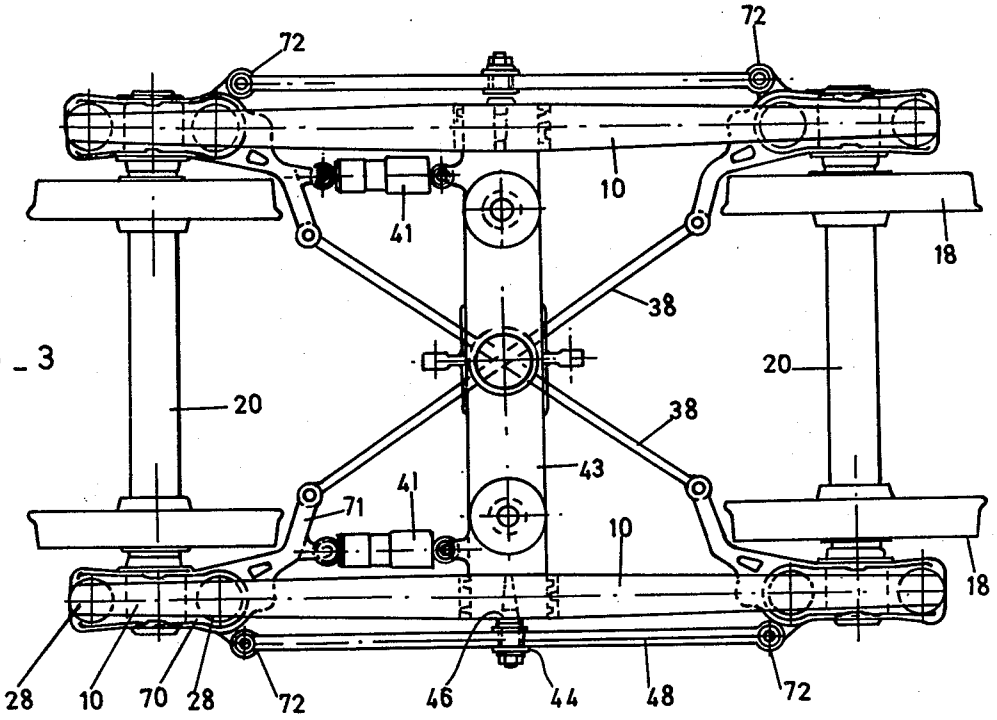
FIG. 3 is a plan view of another embodiment.
Figure 4:
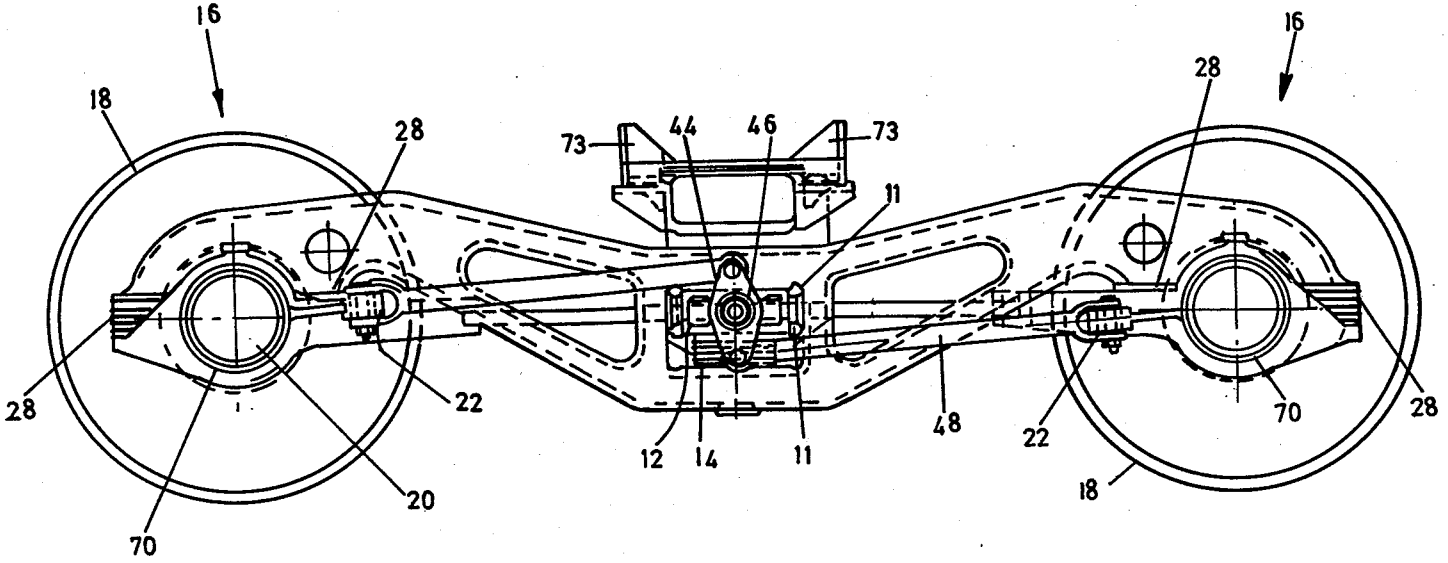
FIG. 4 is a side view of the embodiment of FIG. 3.

In the embodiment of FIGS. 3 and 4 there are also two side frames 10, cross-beam 43 supported on a rubber sandwich 14 with wheelsets 16 having axles 20 and wheels 18 of high effective conicity.

In this case the side frames 10 are shaped to rest on sandwich elements 28 resting on bearing housings 70. Each housing 70 is integral with an arm 71 passing under a side frame 10. Crossed diagonally extending linkages 38 are pivotally secured to the arms 71 to provide the first interconnecting means. In this case a pair of longitudinal dampers 41 connect two arms 71 to the cross-beam 43.

Also in this case there is an additional interconnecting means comprising a lever 44, pivoted on a stub axle 46 and links 48. The stub-axle in this case is secured to the cross-beam 43. Also the links 48 are connected to holed lugs 72 integral with the bearing housings 70.

The longitudinal axes of the links 48 in use are on a line which intersects or passes close to the axis of rotation of the shafts 20.

In this case also the interconnecting means couples longitudinal and yawing movements of the bogie frame to the wheelsets. The cross-beam 43 will normally carry a bolster 73 and the latter would be connected to the vehicle body to ensure that yawing movements are also transmitted to and from the body.

I claim:

1. A railway truck having a longitudinal axis in its direction of travel and comprising a load-bearing means; two wheelsets each including an axle fixed to two wheels that have tapered treads for generating steering forces on track curves; a pair of axle boxes on each wheelset; resilient suspension elements suspending the load bearing means to the axle boxes and permitting each wheelset to approach a radial position in a curve; and interconnecting means extending substantially diagonally of the truck and interconnecting the wheelsets to couple their yawing and lateral movements in opposite senses to counteract the tendency of the wheelsets to hunt without interfering with their natural curving characteristics, with the improvement of additional connecting means which includes on each side and spaced from the longitudinal axis of the truck a pair of linkages and a lever arm pivoted at a position between its ends on the loadbearing means about an axis midway between and parallel to the axles with linkages on the same side of the truck connected to opposed ends of the lever arm and each to a separate axle box and with the lever arm being independent of any other connection.

2. A railway truck as claimed in claim 1 in which each lever arm is pivoted about an axis positioned on the plane containing the rotational axes of the two axles.

3. A railway truck as claimed in either of claims 1 or 2 in which the linkages are each pivotally connected to the axle boxes about an axis which is coincident with the rotational axis of the wheelset.

4. A railway truck as claimed in either of claims 1 or 2 in which the linkages are so connected to the axle boxes that the forces applied by a linkage pass through the rotational axis of an axle.

5. A railway truck as claimed in claim 1 including a single damper on each side of the truck between an axle and the load-bearing means.

* * * * *